US006586880B2

(12) United States Patent
Amemiya et al.

(10) Patent No.: US 6,586,880 B2
(45) Date of Patent: Jul. 1, 2003

(54) PARTITION-WALL STRUCTURE FOR PLASMA DISPLAY PANEL

(75) Inventors: Kimio Amemiya, Yamanashi-ken (JP); Tatsuro Sakai, Yamanashi-ken (JP); Hiroyuki Ajiki, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 114 days.

(21) Appl. No.: 09/825,962

(22) Filed: Apr. 5, 2001

(65) Prior Publication Data

US 2001/0030510 A1 Oct. 18, 2001

(30) Foreign Application Priority Data

Apr. 12, 2000 (JP) ..... 2000-110365

(51) Int. Cl.[7] ..... H01J 17/49
(52) U.S. Cl. ..... 313/582
(58) Field of Search ..... 313/582–587, 313/590, 492, 493, 37

(56) References Cited

U.S. PATENT DOCUMENTS 5,136,207 A * 8/1992 Miyake et al. ..... 313/484
6,195,070 B1 * 2/2001 Shinoda et al. ..... 313/485

* cited by examiner

*Primary Examiner*—Sandra O'Shea
*Assistant Examiner*—Sumati Krishnan
(74) *Attorney, Agent, or Firm*—Arent Fox Kintner Plotkin & Kahn

(57) ABSTRACT

Each of partition walls of a plasma display panel has a pair of transverse walls which are disposed in parallel with each other having a space equal to a width of a discharge cell in the column direction, and vertical walls which are disposed between the pair of vertical walls in parallel with each other having a space equal to a width of the discharge cell in the row direction and which are integrally coupled to the pair of transverse walls. Each partition wall defines discharge cells in each line of the plasma display panel, and is formed such that a width of a portion of the transverse wall situated between the adjacent vertical walls is larger than a width of a portion of the transverse wall coupled to the vertical wall.

6 Claims, 10 Drawing Sheets

V 3 – V 3

V 4 – V 4

V 1 − V 1

V 2 − V 2

W1 – W1

W2 – W2

PARTITION-WALL STRUCTURE FOR PLASMA DISPLAY PANEL

BACKGROUND OF THE INVENTION

1. Field of the Invention

The invention relates to a structure of partition wall for defining unit-light emitting areas in a surface discharge scheme AC type plasma display panel.

2. Description of the Related Art

Recent years, a plasma display panel of a surface discharge scheme AC type as an oversize and slim display for color screen has been received attention, which is becoming widely available.

FIGS. 9 to 13 schematically show the cell structure for the surface discharge scheme AC type plasma display panel which has been proposed by the present applicant. FIG. 9 is a front view of the cell structure. FIG. 10 is a sectional view taken along the V1—V1 line of FIG. 9. FIG. 11 is a sectional view taken along the V2—V2 line of FIG. 9. FIG. 12 is a sectional view taken along the W1—W1 line of FIG. 9. FIG. 13 is a sectional view taken along the W2—W2 line of FIG. 9.

In FIGS. 9 to 13, on the backside of a front glass substrate 1 to serve as a display screen of the plasma display panel (referred as "PDP" hereinafter), a plurality of row electrode pairs (x, Y) are arranged in parallel to extend in the row direction of the front glass substrate 1 (in the left-to-right direction of FIG. 9).

The row electrode X is composed of T-shaped transparent electrodes Xa formed of a transparent conductive film made of ITO (Indium Tin Oxide) or the like, and a bus electrode Xb which is formed of a metal film, extends in the row direction of the front glass substrate land connects to narrowed proximal ends of the transparent electrodes Xa.

Similarly, the row electrode Y is composed of T-shaped transparent electrodes Ya formed of a transparent conductive film made of ITO (Indium Tin Oxide) or the like, and a bus electrode Yb which is formed of a metal film, extends in the row direction of the front glass substrate 1 and connects to narrowed proximal ends of the transparent electrodes Ya.

The row electrodes X and Y are alternated on the front glass substrate 1 in the column direction (in the vertical direction of FIG. 9). The transparent electrodes Xa or Ya disposed along the bus electrodes Xb, Yb extend toward the corresponding row electrode X or Y such that the tops of the widened distal ends of the transparent electrodes Xa, Ya face each other to interpose a discharge gap g, having a predetermined width, between them.

Each of the bus electrodes Xb, Yb is formed in a double layer structure with a black conductive layer Xb', Yb' on the display surface side and a main conductive layer Xb", Yb" on the back surface side.

A dielectric layer 2 is formed further on the backside of the front glass substrate 1 to overlay the row electrode pairs (X, Y). Furthermore, on the backside of the dielectric layer 2, an additional dielectric layer 2A is formed in each position which opposes adjacent bus electrodes Xb and Yb of the two row electrode pairs (X, Y) adjacent to each other, and additionally which opposes an area between the adjacent bus electrodes Xb and Yb, to protrude from the backside of the dielectric layer 2 and to extend in parallel with the bus electrodes Xb, Yb.

On the backsides of the dielectric layer 2 and the additional dielectric layers 2A, a protective layer 3 made of MgO is formed.

Next, a back glass substrate 4 is arranged in parallel with the front glass substrate 1. On the front surface of the back glass substrate 4 facing toward the display surface, column electrodes D are disposed in parallel at regularly established intervals from each other to extend at positions, opposing the transparent electrodes Xa and Ya of the row electrode pairs (X, Y), in a direction orthogonal to the row electrode pair (X, Y) (the column direction).

A white dielectric layer 5 is further formed on the face of the back glass substrate 4 on the display surface side to overlay the column electrodes D.

On the dielectric layer 5, a plurality of partition walls 6 are disposed in the column direction regularly spaced from each other with an interstice SL' extending in the row direction. The partition wall 6 is shaped in a ladder pattern by vertical walls 6*a* each extending in the column direction between the two column electrodes D arranged in parallel with each other, and transverse walls 6*b* each extending in the row direction in a position opposing each additional dielectric layer 2A. The ladder-patterned partition walls 6 define the space between the front glass substrate 1 and the back glass substrate 4 into areas opposing the paired transparent electrodes Xa and Ya of each row electrode pair (X, Y), to form a quadrangular discharge cell C in each area.

For providing the partition walls 6, a glass material layer of a predetermined thickness is formed on the dielectric layer 5 and undergoes a sandblast process to be cut through a mask having a predetermined pattern, and then the patterned glass material layer is burned.

A face of the vertical wall 6*a* of the partition wall 6 on the display surface side is out of contact with the protective layer 3 (see FIGS. 11, 12) to form a clearance r therebetween. On the other hand, a face of the transverse wall 6*b* on the display surface side is in contact with a portion of protective layer 3 overlaying the additional dielectric layer 2A (see FIGS. 10, 11) to shield the adjacent discharge spaces S from each other in the column direction.

On the five faces of a surface of the dielectric layer 5 and the side faces of the vertical walls 6*a* and the transverse walls 6*b* of the partition wall 6 facing each discharge space S, a phosphor layer 7 is formed to overlay all of the five faces.

Colors of the phosphor layers 7 are set in order of red, green and blue for the sequence of discharge spaces S in the row direction.

The inside of the discharge space S is filled with a discharge gas.

Between the front glass substrate 1 and the dielectric layer 2, a black light absorption layer 8 is formed at a position, which opposes the interstice SL' between the adjacent partition walls 6 and which is situated between the back-to-back bus electrodes Xb and Yb of the respective row electrode pairs (X, Y) adjacent to each other in the column direction, to extend along the above bus electrodes Xb, Yb in the row direction. Furthermore, a light absorption layer 9 is formed at a position opposing the vertical wall 6*a* of the each partition wall 6.

In the above PDP, each row electrode pair (X, Y) makes up a display line (row) L on a matrix display screen, and each discharge space S defined by each ladder-patterned partition wall 6 forms a discharge cell C.

In the above PDP, an image is displayed as follows: first, through addressing operation, discharge is caused selectively between the row electrode pairs (X, Y) and the column electrodes D in the particular discharge cells C, to scatter lighted cells (the discharge cell C in which wall charge is formed on the dielectric layer 2) and nonlighted cells (the discharge cell C in which wall charge is not formed on the dielectric layer 2), over the panel in accordance with the image to be displayed.

After the addressing operation, in all the display lines L, the discharge sustain pulses are applied alternately to the row electrode pairs (X, Y) in unison, and thus surface discharge is produced in each lighted cell on every application of the discharge sustain pulse.

In this manner, the surface discharge in each lighted cell generates ultraviolet radiation, and thus the red, green and blue phosphor layers 7 particularly formed in the discharge cells C are selectively excited to emit light, resulting in forming the display screen.

The above PDP has a feature in that since each partition wall 6 defines the discharge cells C in a pattern in which parallel lines cross at right angles, and the transparent electrodes Xa, Ya of the row electrodes X, Y extend from the corresponding bus electrodes Xb, Yb toward each other to independently shape into an island-like form in each discharge cell C, even if each discharge cell is reduced in size to increase definition of a screen, there may not be occurrence of interference between the discharges of the adjacent discharge cells in the row direction.

The above PDP has another feature in that: it is possible to form each partition wall 6 in a ladder pattern independently for each row and thus forming the transverse wall 6*b* which is approximately equal in width to the vertical wall 6*a*. Therefore, when the partition walls 6 are burned, there is little difference in shrinkage produced during the burning between the vertical wall 6*a* and the transverse wall 6*b*. This results in preventing deformation of the discharge cells from being caused by a wrap in the front glass substrate 1 or the back glass substrate 4, damage of the partition wall 6, and so on.

However, when each partition wall 6 is formed in the ladder pattern as in the foregoing PDP, another disadvantage arises. That is to say, in burning the partition wall 6, each of the transverse walls 6*b* on both ladder-sides of the partition wall 6 are drawn inward by the shrinkage of the vertical walls 6*a* as illustrated in FIG. 14, and therefore an opposite side of the transverse wall 6*b*, which is opposite to a supported side by joining with the dielectric layer 5 (the upper side in FIG. 14) are mutually inclined inward.

For overcoming the disadvantage, if a width of the transverse wall 6*b* is designed to be larger than that of the vertical wall 6*a*, as described above, a difference in shrinkage caused by the burning may be produced between the vertical wall 6*a* and the transverse wall 6*b* to cause the deformation in the discharge cell C. Alternatively the shrinkage may cause a great tensile internal stress in the vertical wall 6*a* to cut the vertical wall 6*a*.

Moreover, in the construction of the PDP as described above, the protective layer 3 overlaying the additional dielectric layer 2A is in contact with the transverse walls 6*b* of each partition wall 6 to completely shield the adjacent discharge cells C from each other in the column direction. The complete shielding does not fully provide the priming effect, which induces discharge between the adjacent discharge cells C, in the column direction. This increases a discharge delay time in selecting the discharge in the addressing operation when the image is formed. In order to prevent extension of the discharge delay time, if a drive pulse applied in the addressing operation for stabilizing the selective discharge increases in width, this produces another disadvantage in which the time required for the addressing operation is extended.

SUMMARY OF THE INVENTION

The present invention has been made to overcome the disadvantages associated with the surface discharge scheme AC type plasma display panel as described above.

It is therefore a first object of the present invention to prevent partition walls for defining unit light emitting areas (discharge cells) in a pattern, in which parallel lines cross at right angles, from being damaged and deforming in a forming process for the partition walls.

It is a second object of the present invention to make it possible to ensure priming effect even between unit light emitting areas (discharge cells) adjacent to each other in a column direction.

To attain the first object, a partition wall structure for a plasma display panel according to a first invention advantageously includes partition walls in order that a discharge space, which is formed between a front substrate and a back substrate of the plasma display panel including a plurality of row electrode pairs extending in a row direction and arranged on the front substrate in a column direction and a plurality of column electrodes extending in the column direction and arranged on the back substrate in the row direction, is defined in each intersecting position of the row electrode pair and the column electrode to form unit light emitting areas. Such partition wall includes a pair of transverse walls placed in parallel with each other having a space equal to the width of the unit light emitting area in the column direction, and vertical walls placed between the pair of transverse walls in parallel with each other having a space equal to the width of the unit light emitting area in the row direction and integrally coupled to the pair of transverse walls, to define the unit light emitting areas in each line of the plasma display panel. Further, the partition wall is formed to have a width of a portion of the transverse wall situated between the adjacent vertical walls in a parallel direction to the vertical wall, larger than a width of a portion of the transverse wall coupled to the vertical wall in the same direction.

With the partition wall structure for the plasma display panel according to the first invention, when the formation of partition walls is performed by burning a glass material layer which is formed in a required thickness and patterned, the transverse wall is formed such that its width of the portion situated between the adjacent vertical walls is lager than its width of the portion coupling to the vertical wall, to reinforce the portion situated between the adjacent vertical walls. Hence, the transverse wall has durability to withstand a tensile force produced by the shrinkage of the vertical wall in burning.

In consequence, according to the first invention, the transverse walls are prevented from deforming and being damaged when the partition walls are burned. The partition walls enable to define the unit light emitting areas in a desired shape.

To attain the first object, the partition wall structure for the plasma display panel according to a second invention features, in addition to the configuration of the first invention, in that the width of the portion of the transverse wall coupled to the vertical wall is formed to be approximately the same as a width of the vertical wall in a direction orthogonal to a longitudinal direction of the vertical wall.

According to the partition wall structure for the plasma display panel of the second invention, due to the approximately equal size in width between the portion of the transverse wall coupled to the vertical wall and the vertical wall, the tensile internal stress produced in the vertical wall by the shrinkage produced in burning is reduced. For this reason, the vertical wall is prevented from cutting and a shrinkage ratio is approximately equal between the vertical wall and the portion of the transverse wall coupled to the vertical wall, resulting in preventing the partition wall from being deformed by the shrinkage produced in burning.

To attain the second object, the partition wall structure for the plasma display panel according to a third invention features, in addition to the configuration of the first invention, in that a thickness of the portion of the transverse wall coupled to the vertical wall is formed to be smaller than a thickness of a portion of the transverse wall situated between the adjacent vertical walls to form a groove making communication between the inside and the outside of the transverse wall on the portion of the transverse wall coupled to the vertical wall.

According to the partition wall structure for the plasma display panel of the third invention, the partition walls are disposed in the discharge space between the front substrate and the back substrate of the plasma display panel while extending in the row direction and being arranged in parallel with each other with spacing at required intervals in the column direction. In this case, even when the transverse wall shields the back substrate from the front substrate, each unit light emitting area defined by the partition wall is communicated with the interstice, which is formed between the adjacent partition walls in the column direction, via the groove formed on the portion of the transverse wall coupled to the vertical wall.

In consequence, even when the transverse wall of the partition wall shields the adjacent unit light emitting areas from each other in the column direction, priming particles (a pilot flame) which are produced by the discharge in the interstice between the adjacent transverse walls associated with the discharge caused in the unit light emitting area, are scattered via the groove into an adjacent unit light emitting area in the column direction to induce the discharge, resulting in ensuring the priming effect between the adjacent unit light emitting areas in the column direction.

To attain the first object, a partition wall structure for a plasma display panel according to a fourth invention advantageously includes partition walls in order to define a discharge space, which is formed between a front substrate and a back substrate of the plasma display panel including a plurality of row electrode pairs extending in a row direction and arranged on the front substrate in a column direction and a plurality of column electrodes extending in the column direction and arranged on the back substrate in the row direction, in each intersecting position of the row electrode pair and the column electrode to form unit light emitting areas. Such partition wall includes a pair of transverse walls placed in parallel with each other having a space equal to a width of the unit light emitting area in the column direction, and vertical walls placed between the pair of transverse walls in parallel with each other having a space equal to a width of the unit light emitting area in the row direction and integrally coupled to the pair of transverse walls, to define the unit light emitting areas in each line of the plasma display panel. The partition walls defining the unit light emitting areas in each line are arranged in parallel with each other, to face a portion of the transverse wall coupled to the vertical wall toward a corresponding portion of a transverse wall coupled to a vertical wall of an adjacent partition wall with spacing at a required interval, and to form a portion of the transverse wall situated between the adjacent vertical walls integrally with a corresponding portion of a transverse wall situated between adjacent vertical walls of an adjacent partition wall.

With the partition wall structure for the plasma display panel according to the fourth invention, when the formation of partition walls is performed by burning a glass material layer which is formed in a required thickness and patterned, the transverse wall is formed such that its width of the portion situated between the adjacent vertical walls is lager than its width of the portion coupled to the vertical wall, to reinforce the portion situated between the adjacent vertical walls. Hence, the transverse wall has durability to withstand a tensile force produced by the shrinkage of the vertical wall in burning.

In consequence, according to the fourth invention, the transverse walls are prevented from deforming and being damaged when the partition walls are burned. The partition walls enable to define the unit light emitting areas in a desired shape.

To attain the first object, the partition wall structure for the plasma display panel according to a fifth invention features, in addition to the configuration of the fourth invention, in that the width of the portion of the transverse wall coupled to the vertical wall is formed to be approximately the same as a width of the vertical wall in a direction orthogonal to a longitudinal direction of the vertical wall.

According to the partition wall structure for the plasma display panel of the fifth invention, since the transverse wall is formed such that the width of the portion coupled to the vertical wall is approximately equal to the width in the direction orthogonal to the longitudinal direction of the vertical wall, the tensile internal stress produced in the vertical wall by the shrinkage produced in burning is reduced. For this reason, the vertical wall is prevented from cutting and a shrinkage ratio is approximately equal between the vertical wall and the portion of the transverse wall coupled to the vertical wall, resulting in preventing the partition wall from being deformed by the shrinkage produced in burning.

To attain the second object, the partition wall structure for the plasma display panel according to a sixth invention features, in addition to the configuration of the fourth invention, in that a thickness of the portion of the transverse wall coupled to the vertical wall is formed to be smaller than a thickness of a portion of the transverse wall situated between the adjacent vertical walls to form a groove on the portion coupled to the vertical wall for making communication between the unit light emitting area defined by the partition wall and an interstice formed between the adjacent partition walls.

According to the partition wall structure for the plasma display panel of the sixth invention, the partition walls are disposed in the discharge space between the front substrate and the back substrate of the plasma display panel with the transverse walls thereof being oriented in the row direction. In this event, even when the transverse wall of the partition wall shields the back substrate from the front substrate, each unit light emitting area defined by the partition wall is communicated with the interstice, which is formed between the adjacent transverse walls in the column direction, via the groove formed on the portion of the transverse wall coupling to the vertical wall.

In consequence, even when the transverse wall of the partition wall shields the adjacent unit light emitting areas from each other in the column direction, priming particles (a pilot flame), which are produced by the discharge in the interstice between the transverse walls associated with the discharge caused in the unit light emitting area, are scattered via the groove into an adjacent unit light emitting area in the column direction to induce the discharge, resulting in ensuring the priming effect between the adjacent unit light emitting areas in the column direction.

These and other objects and advantages of the present invention will become obvious to those skilled in the art upon review of the following description, the accompanying drawings and appended claims.

DETAILED DESCRIPTION OF THE PREFERRED EMBODIMENT

Most preferred embodiment according to the present invention will be described hereinafter in detail with reference to the accompanying drawings.

Figure 1:
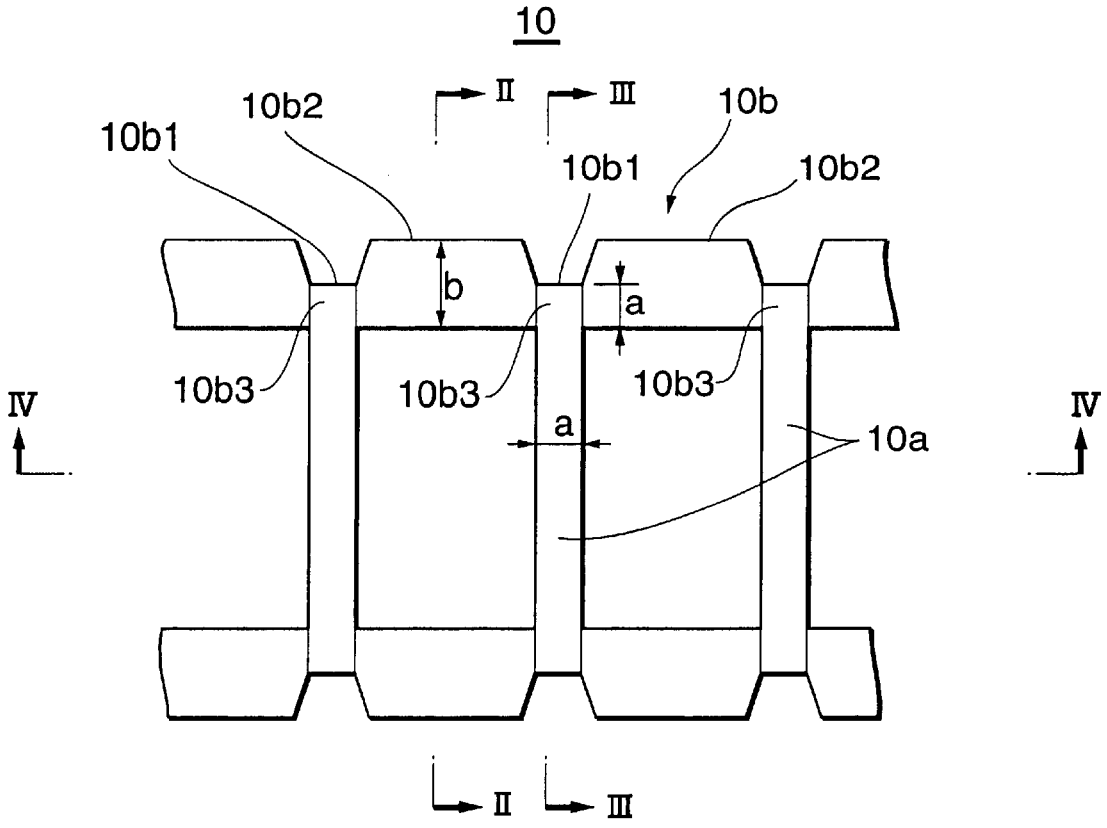
FIG. 1 is a front view showing a first example according to the present invention.
Figure 2A:
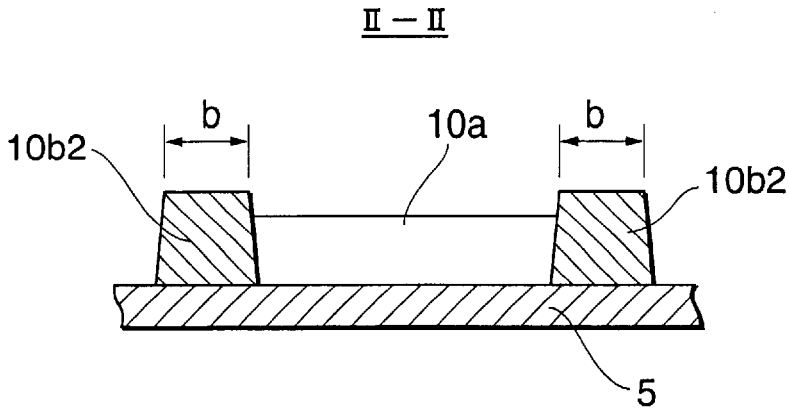
FIG. 2A is a sectional view taken along the II—II line of FIG. 1.
Figure 2B:
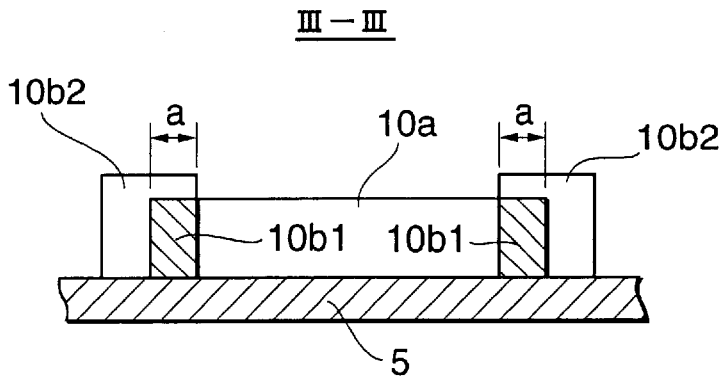
FIG. 2B is a sectional view taken along the III—III line of FIG. 1.
Figure 3:
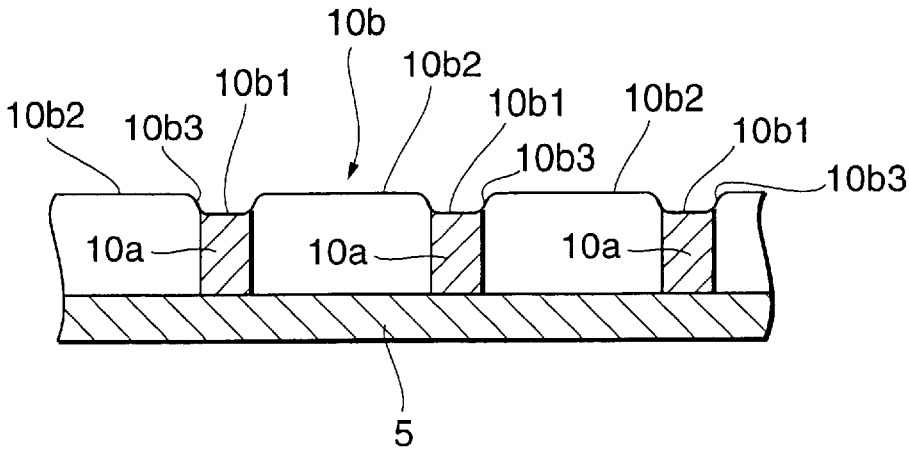
FIG. 3 is a sectional view taken along the IV—IV line of FIG. 1.

FIGS. 1 to 3 illustrate a first example of an embodiment of a partition wall structure for a plasma display panel (referred as "PDP" hereinafter) according to the present invention. FIG. 1 is a front view of the partition wall structure in the first example. FIG. 2A is a sectional view taken along the II—II line of FIG. 1. FIG. 2B is a sectional view taken along the III—III line of FIG. 1. FIG. 3 is a sectional view taken along the IV—IV line of FIG. 1.

A partition wall 10 in the first example is formed in a so-called ladder pattern by a plurality of vertical walls 10*a* which are arranged in parallel with each other at regular intervals and extend in the vertical direction and a pair of transverse walls 10*b* which are respectively spanned in the horizontal direction across the top ends and the bottom ends of the vertical walls 10*a*.

Each transverse wall 10*b* of the partition wall 10 is formed such that a width a of a portion of the transverse wall 10*b* facing the top end or the bottom end of the vertical wall 10*a* (i.e. a width of a coupling portion 10*b*1 of the transverse wall 10*b* at which couples to the vertical wall 10*a*) is equal to a width of the vertical wall 10*a*, and that a width b of a portion thereof in the vertical direction between the top ends or between the bottom ends of the vertical walls 10*a* (i.e. a width of a spanning portion 10*b*2 between the adjacent vertical walls 10*a*), is larger than the width a of the coupling portion 10*b*1.

In FIGS. 2 and 3, reference numeral 5 represents the dielectric layer formed on the back glass substrate (see FIGS. 10 to 13).

As in the case of the PDP illustrated in FIGS. 9 to 13, the partition wall 10 of the first example is formed by steps of forming a glass material layer having a required thickness on the dielectric layer 5, carrying out the sandblast process on the glass material layer to cut it through a mask having a predetermined pattern, and then burning the patterned glass material layer.

Figure 14:
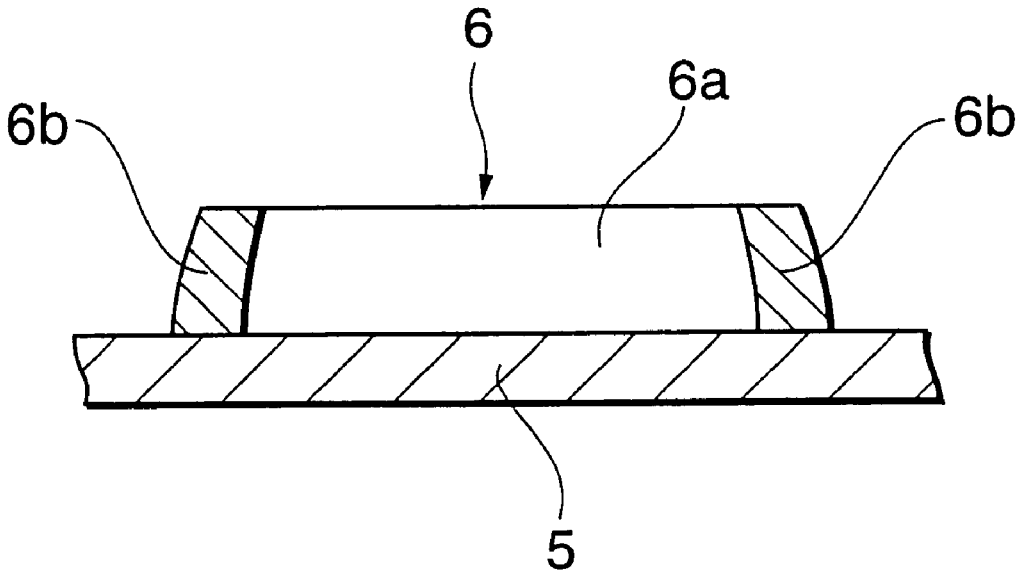
FIG.14 PRIOR ART
FIG. 14 is a sectional side view illustrating a state when a partition wall in the plasma display panel according to the prior proposition is burned.

In this event, since each transverse wall 10*b* is formed to have the width a of the coupling portion 10*b*1 smaller than the width b of the spanning portion 10*b*2, the spanning portion 10*b*2 effects the durability of the transverse wall 10*b* such that it withstands a tensile force caused by the shrinkage of the vertical walls 10*a* during the burning. For this reason, one side of the transverse wall 10*b* supported by the dielectric layer 5 and the opposite side are not drawn by the tensile force caused by the shrinkage of the vertical walls 10*a* during the burning, and thus being prevented from inclining inward as illustrated in FIG. 14.

Further, the transverse wall 10*b* is formed to have the width a at the coupling portion 10*b*1 which is the same as the width of the vertical wall 10*a*. This same width effects suppression of tensile internal stress produced in the vertical wall 10*a* by the shrinkage during the burning, resulting in preventing the vertical wall 10*a* from cutting.

Furthermore, the difference in size between the width a of the coupling portion 10*b*1 and the width b of the spanning portion 10*b*2 in the transverse wall 10*b* produces a difference of shrinkage in the thickness directions of the coupling portion 10*b*1 and the spanning portion 10*b*2. Hence, as illustrated in FIG. 3, the thickness of the coupling portion 10*b*1 of the transverse wall 10*b* becomes smaller than the thickness of the spanning portion 10*b*2 of a larger width so as to form a groove 10*b*3 between the adjacent spanning portions 10*b*2 on the coupling portion 10*b*1.

The groove 10*b*3 formed on the transverse wall 10*b* of the partition wall 10 has an advantage in ensuring the priming effect which induces the discharge between the discharge cells arranged in the column direction of the PDP as described below.

Figure 4:
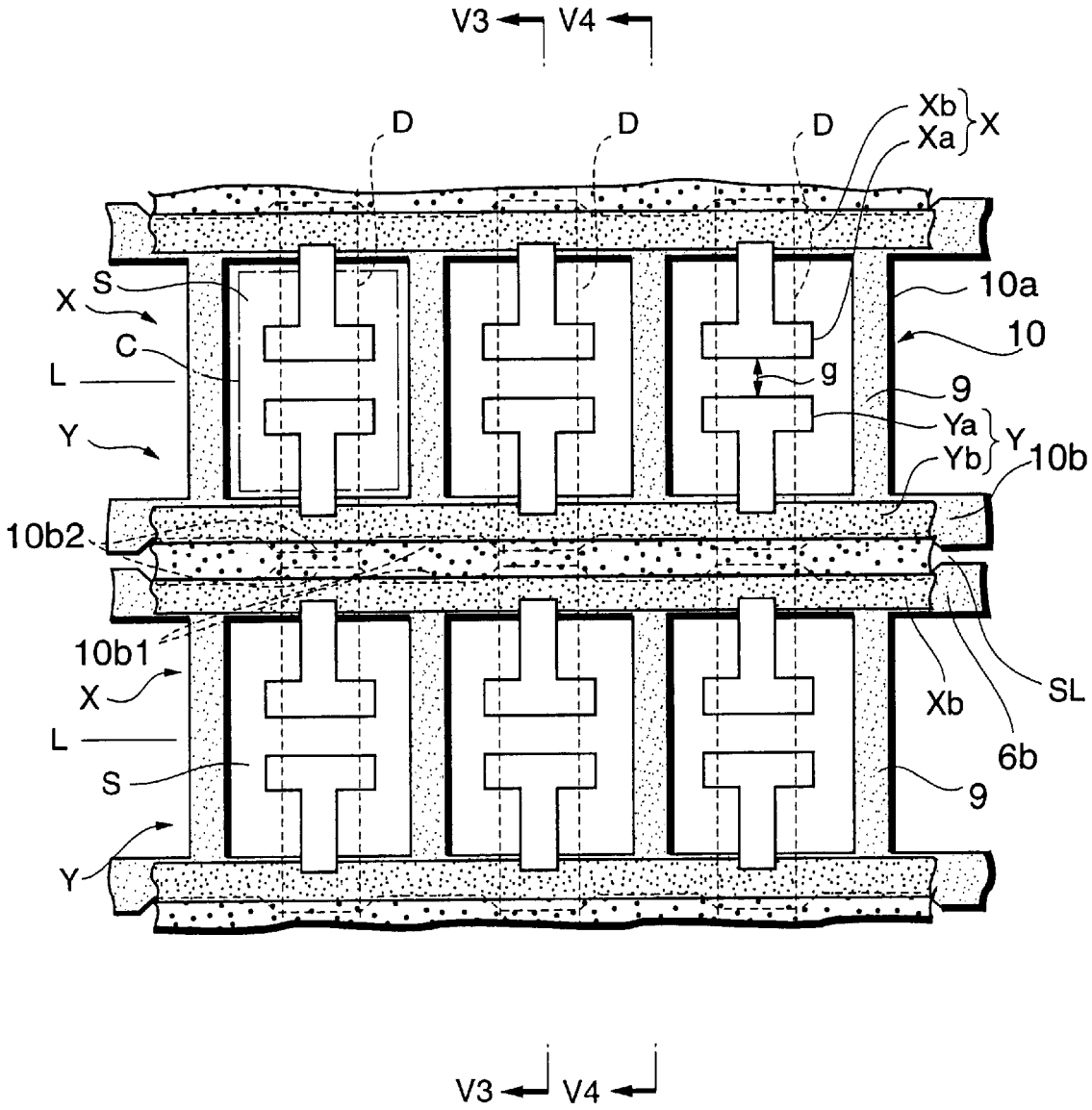
FIG. 4 is a front view schematically showing a plasma display panel provided with partition walls in FIG. 1.
Figure 5:
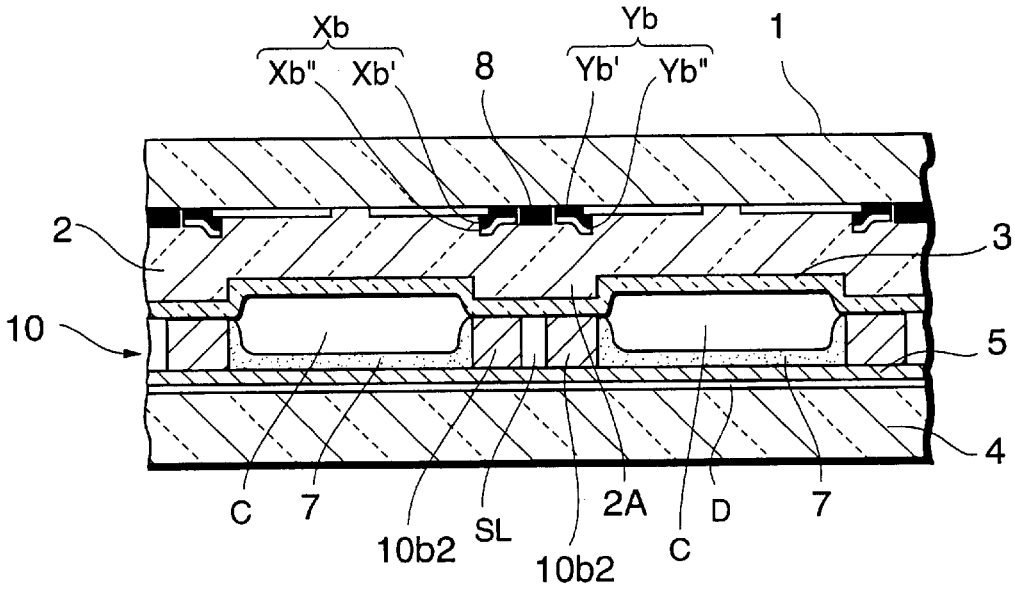
FIG. 5 is a sectional view taken along the V3—V3 line of FIG. 4.
Figure 6:
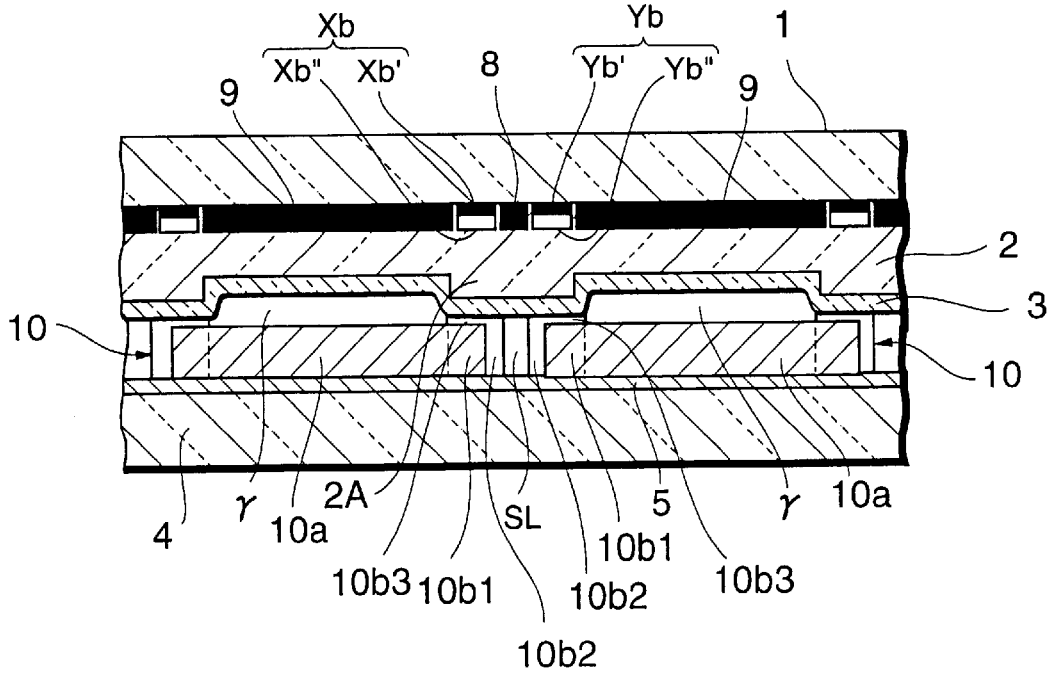
FIG. 6 is a sectional view taken along the V4—V4 line of FIG. 4.

Specifically, as illustrated in FIGS. 4 to 6, a plurality of the partition walls 10 are disposed on the dielectric layer 5 in the column direction to mutually space at predetermined intervals with interstices SL extending in the row direction as in the PDP illustrated in FIGS. 9 to 13. Each ladder-patterned partition wall 10 defines the discharge space S between the front glass substrate 1 and the back glass substrate 4 in the discharge cells C for each area that opposes the transparent electrodes Xa and Ya paired in each row electrode pair (X, Y).

The configuration of other components of the PDP illustrated in FIGS. 4 to 6 is the same as that of the PDP illustrated in FIGS. 9 to 13 and the same reference numerals and symbols are used.

In the PDP, as seen from FIG. 5 showing the sectional view taken along the V3—V3 line of FIG. 4, the transverse wall 10*b* of the partition wall 10 shields the interstice SL from the discharge cell C because the face of the spanning portion 10*b*2 of a larger thickness on the display surface side (the top face in FIG. 5) is in contact with the protective layer 3 overlaying the additional dielectric layer 2A.

As seen from FIG. 6, however, for reason of a smaller thickness of the coupling portion 10*b*1 than that of the spanning portion 10*b*2, the face of the coupling portion 10*b*1 on the display surface side (the top face in FIG. 6) is not in contact with the protective layer 3 overlaying the additional dielectric layer 2A. Therefore, each discharge cell C communicates with the corresponding interstice SL through the groove 10*b*3 formed on the face of the coupling portion 10*b*1 on the display surface side.

With the above configuration, driving pulses (a reset pulse applied to the column electrode D and the row electrode X or Y in a reset operation; a scan pulse applied to one of the row electrodes X, Y in the addressing operation; and a display data pulse applied to the column electrode D) are applied between the column electrode D and the row electrode X or Y to cause reset discharge in the reset operation (discharge for temporarily forming wall charge in all the discharge cells C) and selection discharge in the addressing operation (discharge for selectively erasing the wall charge formed by the reset discharge in accordance with the display image data).

At this time, the discharge is readily caused in the area where the additional dielectric layer 2A is formed because of a shorter discharge distance between the column electrode D and the row electrodes X, Y. For this reason, the discharge is caused between the column electrode D and the row electrodes X, Y in the interstice SL, and priming particles (a pilot flame) caused by the discharge in the interstice SL are scattered via the groove 10*b*3 inside the discharge cells C adjacent to the interstice SL in the column direction, resulting in producing the priming effect of inducing the discharge between the adjacent discharge cells C.

A black or dark brown light-shield layer 8 is formed in an area, as a non-display line, between the bus electrodes Xb and Yb, and the faces of the bus electrodes Xb and Yb on the display surface side are made up of black conductive layers Xb' and Yb', respectively. For this reason, reflection of ambient light is prevented, resulting in improvement in contrast. Additionally, the contrast on the images may not be adversely affected by the light which is produced when the discharge for priming is caused between the column electrode D and the row electrodes X, Y in the interstice SL.

In The PDP, as seen from FIG. 6, since the vertical wall 10*a* faces a portion of the dielectric layer 2 on which the additional dielectric layer 2A is not formed and the vertical wall 10*a* is not in contact with the protective layer 3, the adjacent discharge cells C in the row direction are communicated with each other through the clearance r formed between the vertical wall 10*a* and the dielectric layer 2. Hence, the priming particles scatter through the clearance r in the row direction, resulting in ensuring the priming effect in the row direction.

Figure 7:
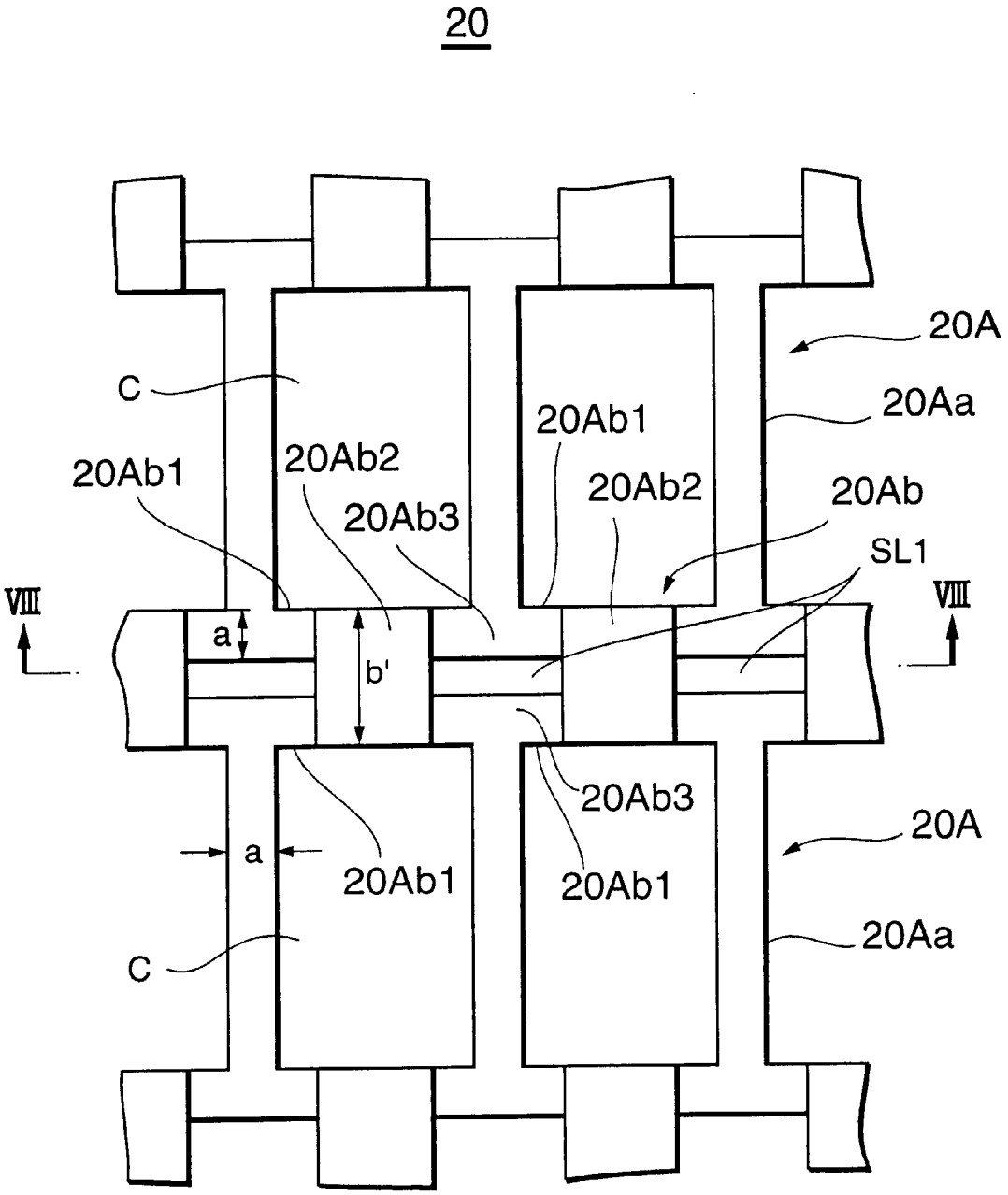
FIG. 7 is a front view showing a second example according to the present invention.
Figure 8:
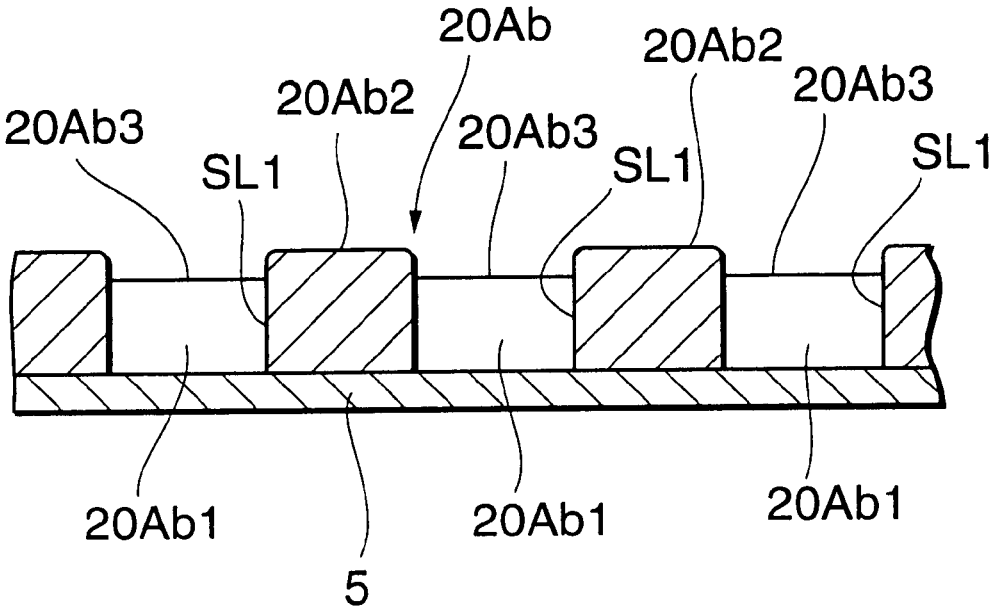
FIG. 8 is a sectional view taken along the VIII—VIII line of FIG. 7.
Figure 9:
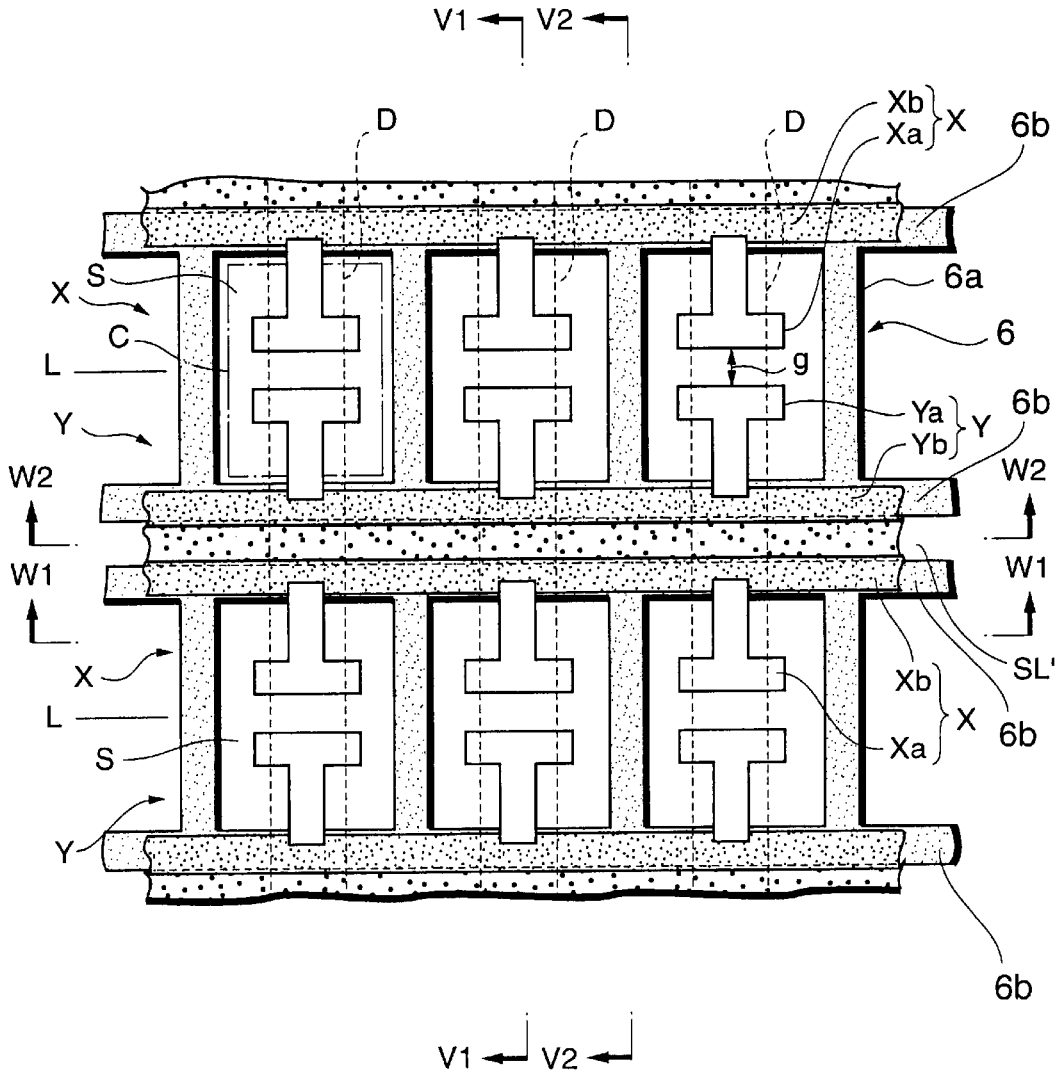
FIG.9 PRIOR ART
FIG. 9 is a front view schematically showing a plasma display panel relating to the prior proposition.
Figure 10:
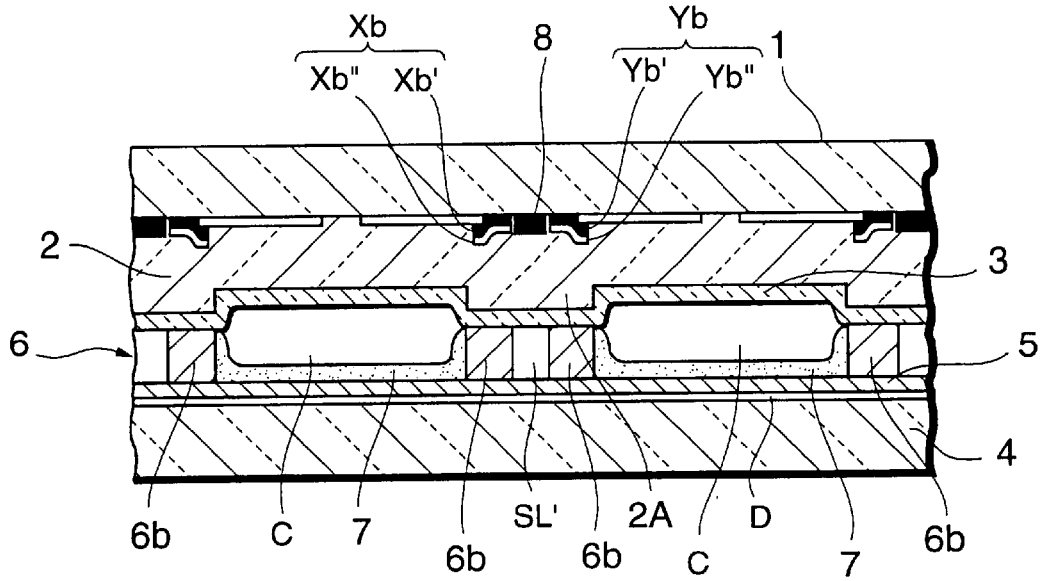
FIG.10 PRIOR ART
FIG. 10 is a sectional view taken along the V1—V1 line of FIG. 9.
Figure 11:
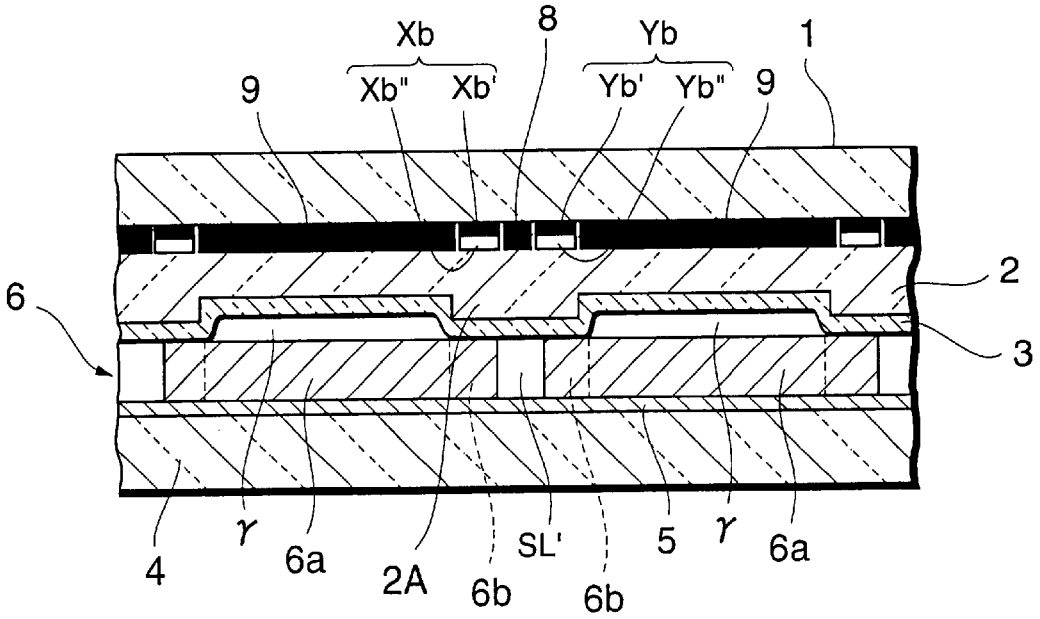
FIG.11 PRIOR ART
FIG. 11 is a sectional view taken along the V2—V2 line of FIG. 9.
Figure 12:
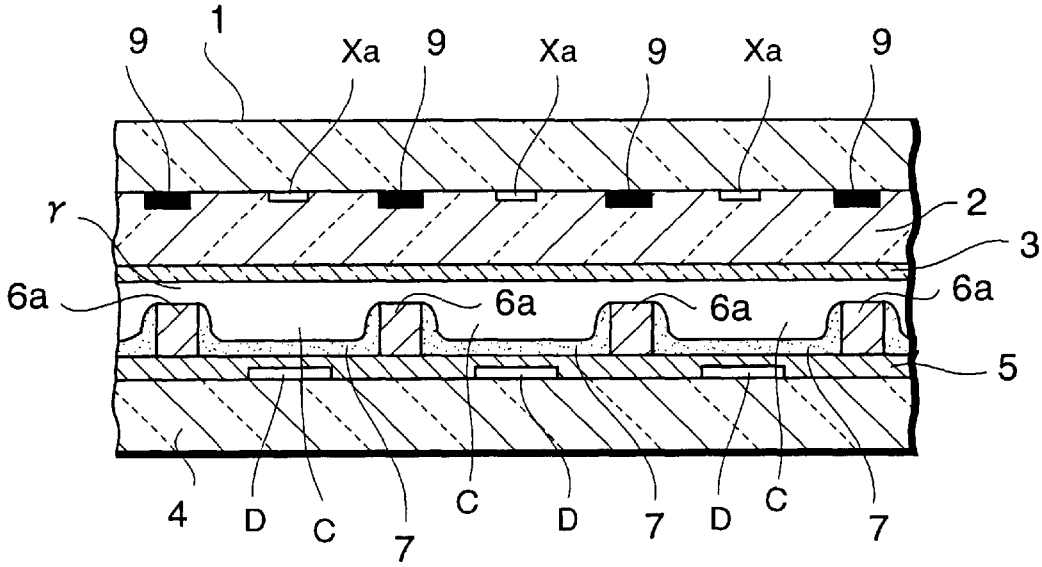
FIG.12 PRIOR ART
FIG. 12 is a sectional view taken along the W1—W1 line of FIG. 9.
Figure 13:
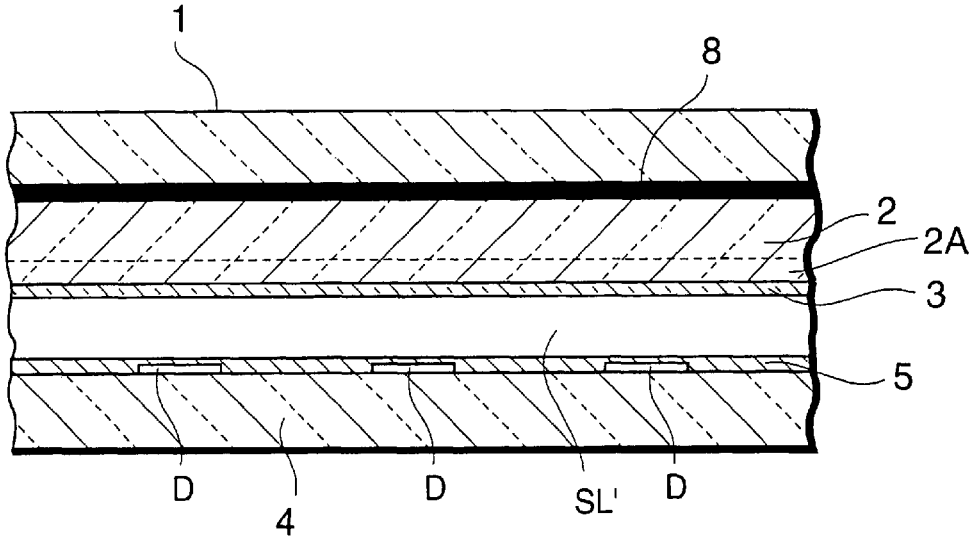
FIG.13 PRIOR ART
FIG. 13 is a sectional view taken along the W2—W2 line of FIG. 9.

FIG. 7 and FIG. 8 are respectively a front view and a sectional view illustrating a second example in the embodiment of the partition wall structure for the plasma display panel according to the present invention.

In FIG. 7, a partition wall 20 includes wall members 20A defining the discharge cells for each line of the PDP. As in the case of the partition wall 10 of the first example, each wall member 20A is formed in a ladder pattern by vertical walls 20A*a* and a pair of transverse walls 20A*b* spanned in the horizontal direction. The wall members 20A are placed in parallel in the column direction with interposing an interstice SL1 of a predetermined width.

The adjacent wall members 20A in the column direction are mutually coupled at the respective portions situated between the adjacent top or bottom end portions of the vertical walls 20A*a* so as to integrally form the partition wall 20. Due to this coupling, a width b' of the spanning portion 20A*b*2 is larger than a width a of the coupling portion 20A*b*1 (corresponding to a portion facing the top or bottom end of the vertical wall 20A*a*) of the transverse wall 20A*b* of the wall member 20A, the width a being set to be equal to that of the vertical wall 20A*a*.

In consequence, as in the partition wall 10 of the first example, with the partition wall 20, the spanning portion 20A*b*2 of each wall member 20A effects the durability of the transverse wall 20A*b* such that the transverse wall 20A*b* withstands a tensile force caused by the shrinkage of the vertical walls 20A*a* during the burning. This prevents the transverse wall 20A*b* from being drawn by the tensile force caused by the shrinkage of the vertical wall 20A*a* during the burning. Deformation in the transverse walls 20A*b* is thus avoided.

Further, the partition wall 20 is formed such that the width a of the coupling portion 20A*b*1 of the transverse wall 20A*b* is the same as the width of the vertical wall 10*a*. This same width effects suppression of tensile internal stress produced in the vertical wall 20A*a* by the shrinkage in burning, resulting in preventing the vertical wall 20A*a* from cutting.

Furthermore, the difference in size between the width a of the coupling portion 20A*b*1 and the width b' of the spanning portion 20A*b*2 in the transverse wall 20A*b* produces a difference of shrinkage in the thickness directions thereof. Hence, a thickness of the coupling portion 20A*b*1 of the transverse wall 20A*b* becomes smaller than the thickness of the spanning portion 20A*b*2 of a larger width so as to form a groove 20A*b*3 between the adjacent spanning portions 20A*b*2 on the coupling portion 20A*b*1, as illustrated in FIG. 8.

For the reason of the groove 20A*b*3, as in the case of the partition wall 10 in the first example, in the case where the partition wall 20 makes up the PDP, the priming particles (a pilot flame) caused by the discharge in the interstice SL1 are scattered via the groove 20A*b*3 inside the adjacent discharge cells C in the column direction, resulting in producing the priming effect of inducing the discharge between the adjacent discharge cells C.

The terms and description used herein are set forth by way of illustration only and are not meant as limitations. Those skilled in the art will recognize that numerous variations are possible within the spirit and scope of the invention as defined in the following claims.

What is claimed is:

1. A partition wall structure for a plasma display panel for defining a discharge space, formed between a front substrate and a back substrate of the plasma display panel including a plurality of row electrode pairs extending in a row direction and arranged on the front substrate in a column direction and a plurality of column electrodes extending in the column direction and arranged on the back substrate in the row direction, in each intersecting position of the row electrode pair and the column electrode to form unit light emitting areas, each having a pair of transverse walls placed in parallel with each other having a space equal to a width of the unit light emitting area in the column direction, and vertical walls placed between said pair of transverse walls in parallel with each other having a space equal to a width of the unit light emitting area in the row direction and integrally coupled to the pair of transverse walls, to define the unit light emitting areas in each line of the plasma display panel, and being formed to have a width of a portion of said transverse wall situated between said adjacent vertical walls in a parallel direction to said vertical wall, larger than a width of a portion of said transverse wall coupled to said vertical wall in the same direction.

2. The partition wall structure for the plasma display panel according to claim 1, wherein said width of the portion of said transverse wall coupled to said vertical wall is formed to be approximately the same as a width of said vertical wall in a direction orthogonal to a longitudinal direction of said vertical wall.

3. The partition wall structure for the plasma display panel according to claim 1, wherein a thickness of the portion of said transverse wall coupled to said vertical wall is formed to be smaller than a thickness of a portion of said transverse wall situated between said adjacent vertical walls to form a groove making communication between the inside and the outside of the transverse wall on the portion of the transverse wall coupled to the vertical wall.

4. A partition wall structure for a plasma display panel for defining a discharge space, formed between a front substrate and a back substrate of the plasma display panel including a plurality of row electrode pairs extending in a row direction and arranged on the front substrate in a column direction and a plurality of column electrodes extending in the column direction and arranged on the back substrate in the row direction, in each intersecting position of the row electrode pair and the column electrode to form unit light emitting areas, each having a pair of transverse walls placed in parallel with each other having a space equal to a width of the unit light emitting area in the column direction, and vertical walls placed between said pair of transverse walls in parallel with each other having a space equal to a width of the unit light emitting area in the row direction and integrally coupled to the pair of transverse walls, to define the unit light emitting areas into each line of the plasma display panel, wherein said partition walls defining the unit light emitting areas in each display line are arranged in parallel with each other, to face a portion of said transverse wall coupled to said vertical wall toward a corresponding portion of a transverse wall coupled to a vertical wall of an adjacent partition wall in the column direction with spacing at a required interval, and to form a portion of said transverse wall situated between said adjacent vertical walls except a portion of said transverse wall coupled with said vertical wall integrally with a corresponding portion of a transverse wall situated between adjacent vertical walls of an adjacent partition wall in the column direction.

5. The partition wall structure for the plasma display panel according to claim 4, wherein said width of the portion of said transverse wall coupled to said vertical wall is formed to be approximately the same as a width of said vertical wall in a direction orthogonal to a longitudinal direction of said vertical wall.

6. The partition wall structure for the plasma display panel according to claim 4, wherein a thickness of the portion of said transverse wall coupled to said vertical wall is formed to be smaller than a thickness of a portion of said transverse wall situated between said adjacent vertical walls to form a groove on said portion coupled to said vertical wall for making communication between the unit light emitting area defined by said partition wall and an interstice formed between the adjacent partition walls.

* * * * *